US010772382B2

(12) United States Patent
Fontaine

(10) Patent No.: US 10,772,382 B2
(45) Date of Patent: Sep. 15, 2020

(54) SHOE HAVING STIFFENING FEATURES

(71) Applicant: Cole Haan LLC, New York, NY (US)

(72) Inventor: Jonathan Fontaine, Greenland, NH (US)

(73) Assignee: COLE HAAN LLC, New York, NY (US)

( * ) Notice: Subject to any disclaimer, the term of this patent is extended or adjusted under 35 U.S.C. 154(b) by 79 days.

(21) Appl. No.: 15/996,684

(22) Filed: Jun. 4, 2018

(65) Prior Publication Data

US 2019/0365048 A1 Dec. 5, 2019

(51) Int. Cl.
*A43B 23/16* (2006.01)

(52) U.S. Cl.
CPC ..... *A43B 23/16* (2013.01)

(58) Field of Classification Search
CPC ..... A43B 1/04; A43B 13/125; A43B 13/16; A43B 23/16; A43B 23/0245; A43B 23/0275; A43B 23/025; A43C 1/00; A43C 1/04
See application file for complete search history.

(56) References Cited

U.S. PATENT DOCUMENTS

| | | | |
|---|---|---|---|
| D55,529 | S | 6/1920 | Piper |
| 4,468,870 | A | 9/1984 | Sternberg |
| 4,584,783 | A | 4/1986 | Dobbin |
| D325,464 | S | 4/1992 | Smith |
| D330,973 | S | 11/1992 | Hatfield |
| D335,385 | S | 5/1993 | Kawabata |
| D348,561 | S | 7/1994 | Lozano |
| 6,108,943 | A | 8/2000 | Hudson et al. |
| D449,426 | S | 10/2001 | Pollastrelli |
| D542,018 | S | 5/2007 | Matis et al. |
| D550,933 | S | 9/2007 | Hulbert |
| D556,979 | S | 12/2007 | Bramani |
| D565,283 | S | 4/2008 | Smith et al. |
| 7,444,763 | B2 | 11/2008 | Grove et al. |
| D583,141 | S | 12/2008 | Mermet |
| D595,046 | S | 6/2009 | Chang |
| D604,480 | S | 11/2009 | Della Valle et al. |
| D614,387 | S | 4/2010 | Rasmussen |
| D623,841 | S | 9/2010 | Maejima |
| D643,204 | S | 8/2011 | Roulo |
| D643,206 | S | 8/2011 | Chang |
| D653,442 | S | 2/2012 | Hui |
| D683,130 | S | 5/2013 | Rushbrook |

(Continued)

*Primary Examiner* — Ted Kavanaugh
(74) *Attorney, Agent, or Firm* — Thompson Coburn LLP

(57) ABSTRACT

A shoe includes a sole and an upper. The upper has a knitted element being formed of a unitary one-piece construction during a knitting process on a knitting machine. The shoe further includes a lateral stiffening member coupled to the upper in a lateral vamp region a medial stiffening member coupled to the upper in a medial vamp region. The sole has a sole member and a molded chassis. The molded chassis has at least a midfoot region, the midfoot region extending upwardly above a portion of the upper. The lateral stiffening member is spaced from the molded chassis and the sole member and is operatively connected to the molded chassis in the midfoot region. The medial stiffening member is spaced from the molded chassis and the sole member and is operatively connected to the molded chassis in the midfoot region.

18 Claims, 16 Drawing Sheets

(56) References Cited

U.S. PATENT DOCUMENTS

| | | | | |
|---|---|---|---|---|
| D701,036 | S | 3/2014 | Martin | |
| D707,027 | S | 6/2014 | Shaffer | |
| D707,032 | S | 6/2014 | Martin | |
| D709,280 | S | 7/2014 | Shaffer | |
| D714,034 | S | 9/2014 | Valle et al. | |
| D716,540 | S | 11/2014 | Anceresi et al. | |
| D720,522 | S | 1/2015 | Anceresi et al. | |
| D722,224 | S | 2/2015 | Williams, Jr. | |
| D722,225 | S | 2/2015 | Williams, Jr. | |
| D728,205 | S | 5/2015 | Weddle et al. | |
| D745,771 | S | 12/2015 | Cin | |
| D752,332 | S | 3/2016 | Williams, Jr. | |
| D756,621 | S | 5/2016 | Weddle | |
| D778,569 | S | 2/2017 | Chang | |
| D780,431 | S | 3/2017 | Pauk | |
| D781,556 | S | 3/2017 | Nethongkome | |
| D783,975 | S | 4/2017 | Schenone | |
| D783,986 | S | 4/2017 | Williams, Jr. | |
| D783,992 | S | 4/2017 | Sokol | |
| D784,679 | S | 4/2017 | Chang | |
| D796,819 | S | 9/2017 | Chang | |
| D801,664 | S | 11/2017 | Small | |
| D809,270 | S | 2/2018 | Pauk | |
| D809,749 | S | 2/2018 | Brito | |
| D809,768 | S | 2/2018 | Witherow | |
| D817,609 | S | 5/2018 | Boys et al. | |
| D821,712 | S | 7/2018 | Avar et al. | |
| D822,354 | S | 7/2018 | Stavseng et al. | |
| D833,731 | S | 11/2018 | Hernandez | |
| D834,294 | S | 11/2018 | Small | |
| D840,664 | S | 2/2019 | Small | |
| D841,973 | S | 3/2019 | Small | |
| D845,591 | S | 4/2019 | Frank | |
| D849,374 | S | 5/2019 | Hardy | |
| 2010/0154256 | A1* | 6/2010 | Dua | A43B 1/04 36/25 R |
| 2011/0119959 | A1* | 5/2011 | Bodner | A43B 7/32 36/91 |
| 2012/0233882 | A1* | 9/2012 | Huffa | A43B 1/04 36/45 |
| 2016/0286903 | A1* | 10/2016 | Whewell | A43C 11/20 |
| 2017/0071291 | A1* | 3/2017 | Follet | A43D 8/24 |
| 2017/0370027 | A1* | 12/2017 | da Costa Pereira Machado | A43B 23/042 |

* cited by examiner

SHOE HAVING STIFFENING FEATURES

CROSS-REFERENCE TO RELATED APPLICATIONS

Not Applicable.

STATEMENT REGARDING FEDERALLY SPONSORED RESEARCH OR DEVELOPMENT

Not Applicable.

APPENDIX

Not Applicable.

BACKGROUND

Field

This disclosure pertains to shoes having stiffening features.

SUMMARY

One aspect of the disclosure pertains to a shoe having a sole and an upper. The upper is secured to the sole. The upper has a knitted element being formed of a unitary one-piece construction during a knitting process on a knitting machine. The upper has a toe region, a vamp region having a lateral vamp region and a medial vamp region, a throat region, and a quarter region. The toe region extends longitudinally to the vamp region, the vamp region extends longitudinally and laterally to the throat region, the lateral vamp region extends laterally and in a lateral direction from the throat region, the medial vamp region extends laterally and in a medial direction from the throat region, and the vamp region extends to the quarter region. The shoe further includes a lateral stiffening member coupled to the upper in the lateral vamp region. The lateral stiffening member is adapted and configured to stiffen the upper. The shoe further includes a medial stiffening member coupled to the upper in the medial vamp region. The medial stiffening member is adapted and configured to stiffen the upper. The sole extends longitudinally from a sole heel end to a sole toe end and extends transversely from a sole lateral edge to a sole medial edge. The sole includes a heel region, a midfoot region, a ball region and a toe region. The heel region extends longitudinally from the sole heel end to the midfoot region, and the midfoot region extends longitudinally from the heel region to the ball region and has a lateral midfoot region and a medial midfoot region. The lateral midfoot region extends transversely from the lateral edge to the medial midfoot region, the medial midfoot region extends transversely from the medial edge to the lateral midfoot region, the ball region of the sole extends longitudinally from the midfoot region to the toe region, and the toe region extends longitudinally from the ball region to the sole toe end. The sole has a sole member and a molded chassis. The sole member extends from the sole heel end to the sole toe end. The molded chassis is coupled to the sole member. The molded chassis has at least a midfoot region, the midfoot region extending upwardly above a portion of the upper. The midfoot region of the molded chassis member is in the midfoot region of the sole. The lateral stiffening member is spaced from the molded chassis and is spaced from the sole member. The lateral stiffening member is operatively connected to the molded chassis in the midfoot region, and the lateral stiffening member defines at least one opening adapted and configured to receive a shoe lace. The medial stiffening member is spaced from the molded chassis and is spaced from the sole member. The medial stiffening member is operatively connected to the molded chassis in the midfoot region, and the medial stiffening member defines at least one opening adapted and configured to receive a shoe lace.

Another aspect of the disclosure pertains to a shoe having a sole and an upper. The upper is secured to the sole. The upper has a knitted element being formed of a unitary one-piece construction during a knitting process on a knitting machine. The upper has a toe region, a vamp region having a lateral vamp region and a medial vamp region, a throat region, and a quarter region. The toe region extends longitudinally to the vamp region, the vamp region extends longitudinally and laterally to the throat region, the lateral vamp region extends laterally and in a lateral direction from the throat region, the medial vamp region extends laterally and in a medial direction from the throat region, and the vamp region extends to the quarter region. The shoe further includes a unitary one-piece stiffening member having a bottom portion, a lateral side portion, and a medial side portion. The bottom portion extends laterally between a first end and a second end, the second opposite the first end. The lateral side portion extends upwardly from the first end of bottom portion, and the medial side portion extends upwardly from the second end of the bottom portion. The sole extends longitudinally from a sole heel end to a sole toe end and extends transversely from a sole lateral edge to a sole medial edge. The sole includes a heel region, a midfoot region, a ball region and a toe region. The heel region extends longitudinally from the sole heel end to the midfoot region, and the midfoot region extends longitudinally from the heel region to the ball region and has a lateral midfoot region and a medial midfoot region. The lateral midfoot region extends transversely from the lateral edge to the medial midfoot region, the medial midfoot region extends transversely from the medial edge to the lateral midfoot region, the ball region of the sole extends longitudinally from the midfoot region to the toe region, and the toe region extends longitudinally from the ball region to the sole toe end. The sole has a sole member and a molded chassis. The sole member extends from the sole heel end to the sole toe end. The molded chassis is coupled to the sole member. The molded chassis has at least a midfoot region, the midfoot region extending upwardly above a portion of the upper. The midfoot region of the molded chassis member is in the midfoot region of the sole. The stiffening member is coupled to one or more of the sole member and the molded chassis member in the midfoot region. The lateral side portion of the stiffening member extends upwardly above the lateral midfoot region of the sole. The lateral side portion of the stiffening member overlaps a portion of the lateral vamp region of the upper. The medial side portion of the stiffening member extends upwardly above the medial midfoot region of the sole. The medial side portion of the stiffening member overlaps a portion of the medial vamp region of the upper. The lateral side of the stiffening member has at least one opening adapted and configured to receive a shoe lace, and the medial side of the stiffening member has at least one opening adapted and configured to receive a shoe lace.

Further features and advantages of the present disclosure, as well as the operation of the embodiments described herein, are described in detail below with reference to the accompanying drawings.

Figure 1:
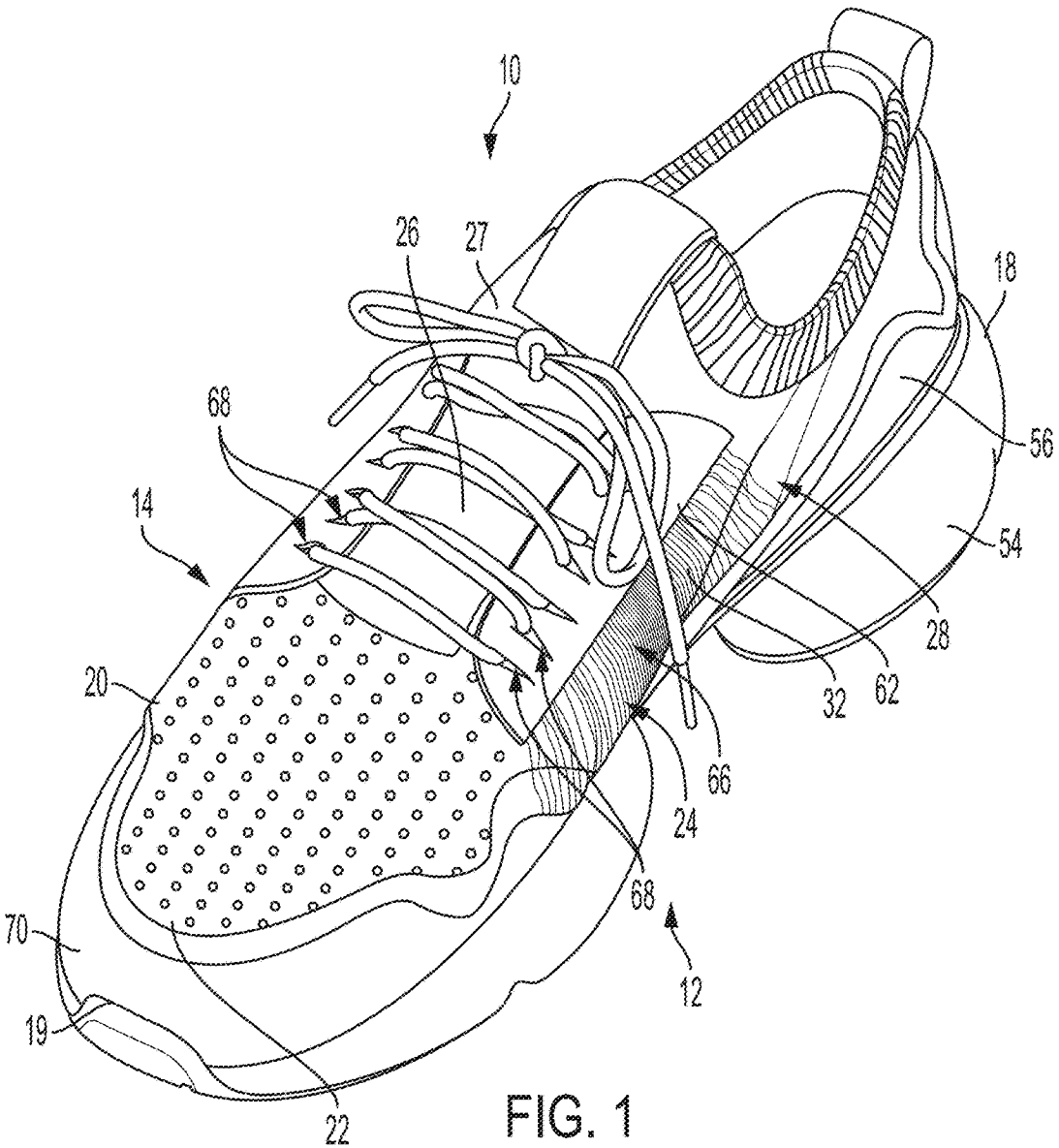
FIG. 1 is a perspective view of an embodiment of a shoe, the shoe including stiffening members.
Figure 2:
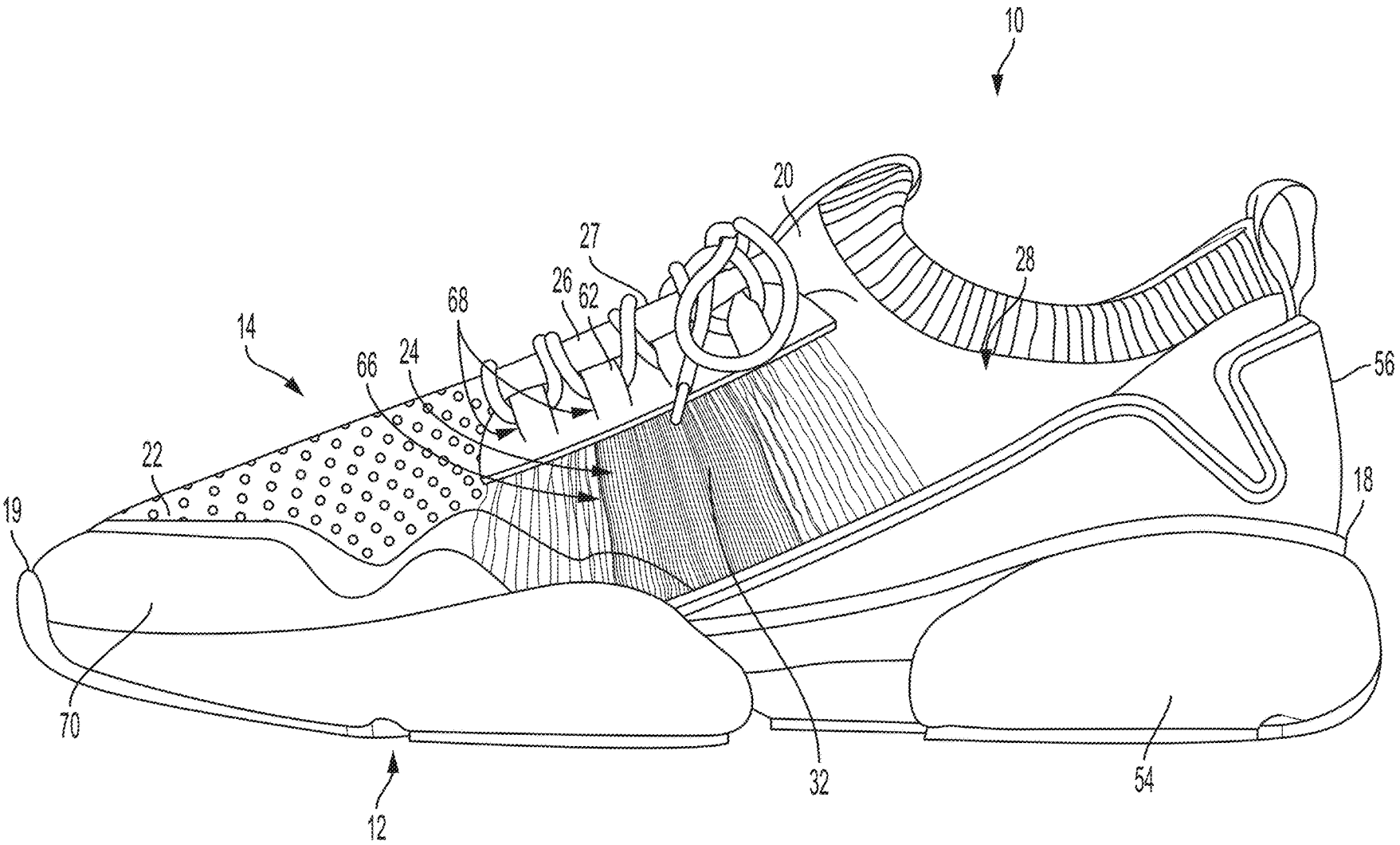
FIG. 2 is a medial side view of the shoe shown in FIG. 1.
Figure 3:
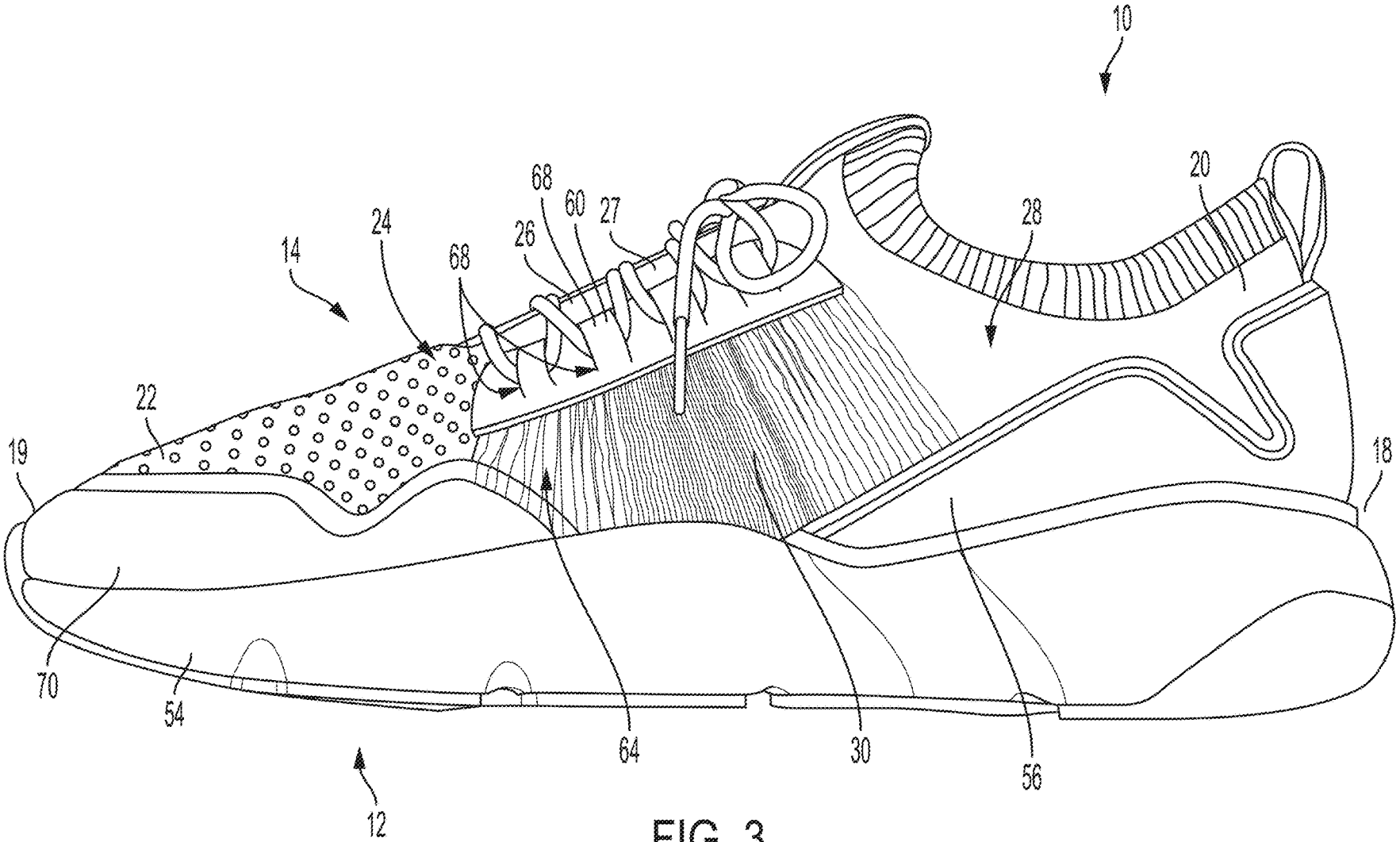
FIG. 3 is a lateral side view of the shoe shown in FIG. 1
Figure 4:
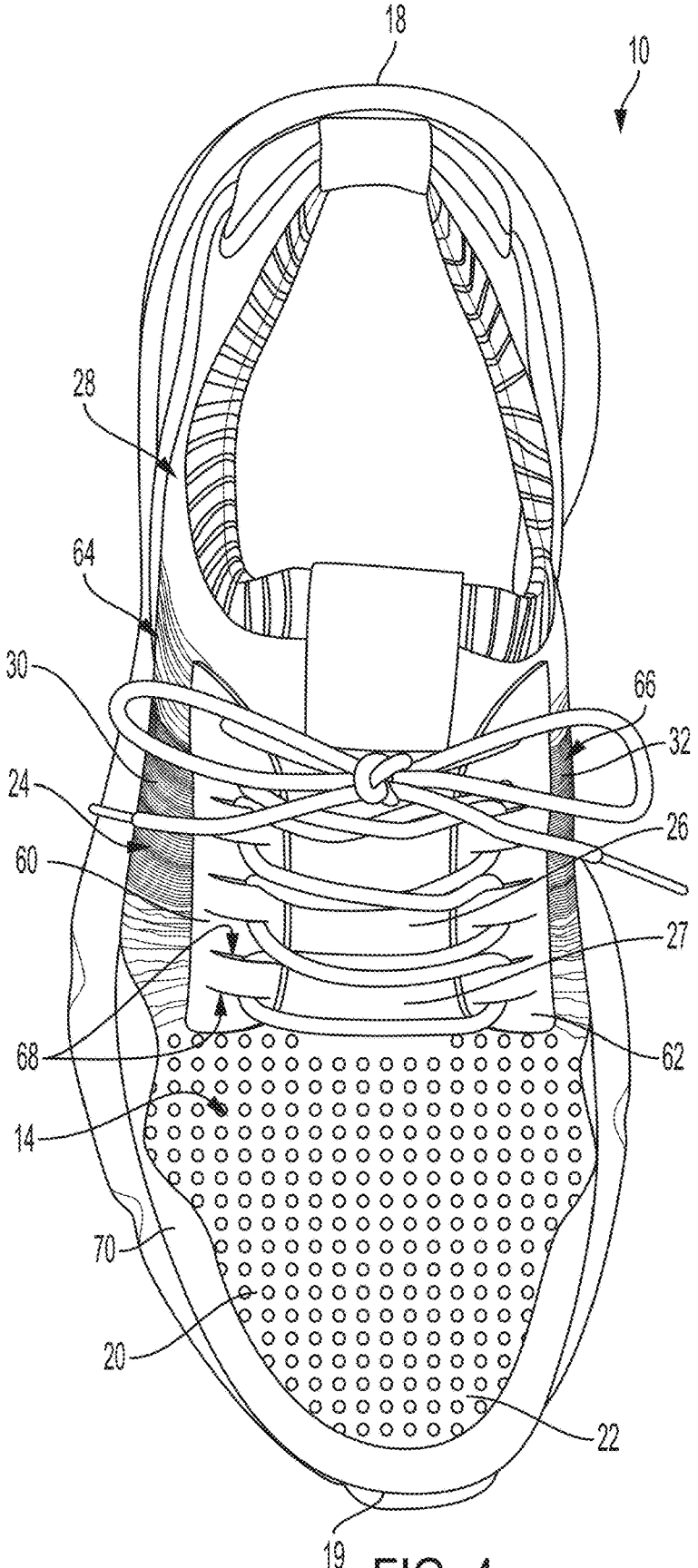
FIG. 4 is a top view of the shoe shown in FIG. 1.
Figure 5:
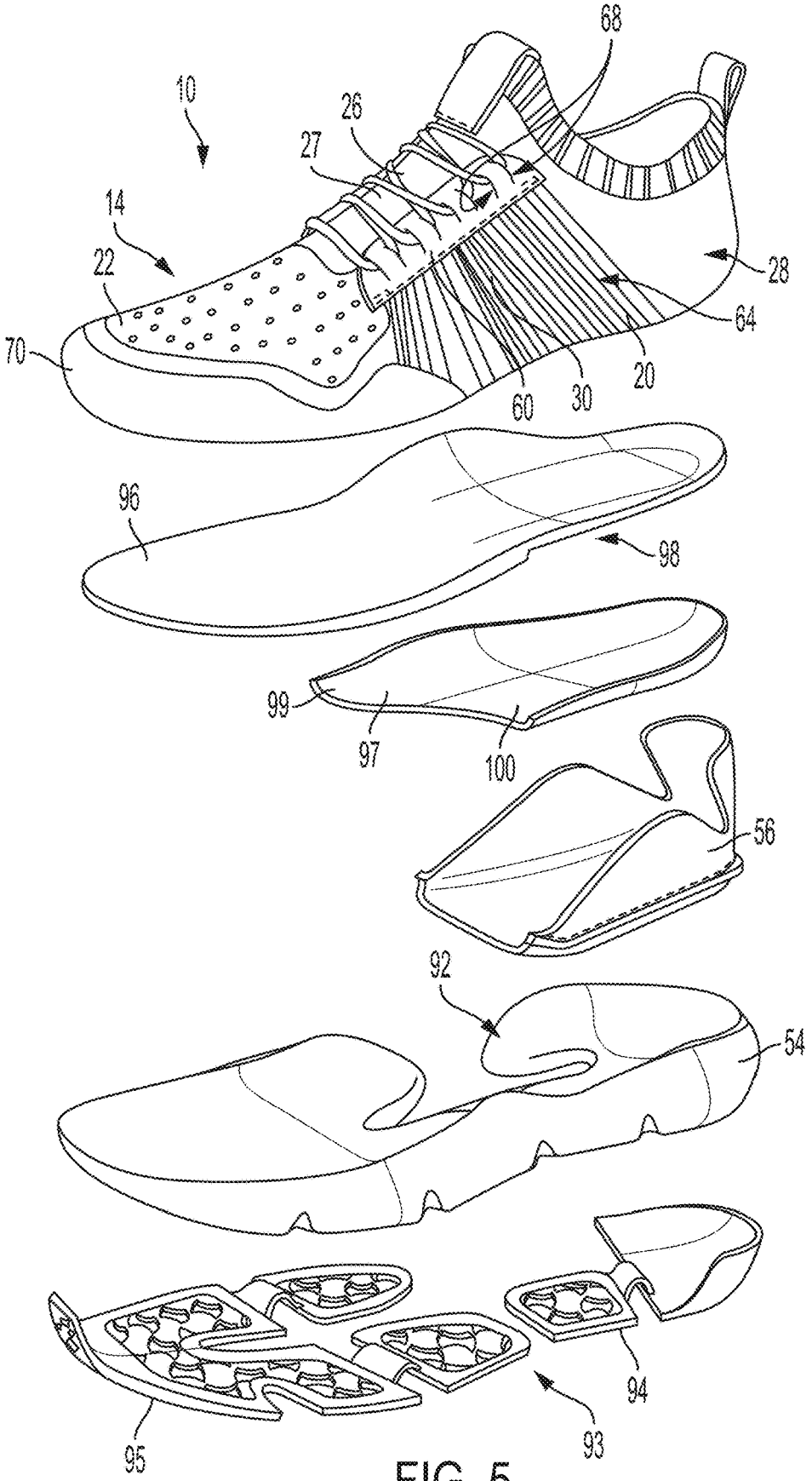
FIG. 5 is an exploded view of the shoe shown in FIG. 1.
Figure 6:
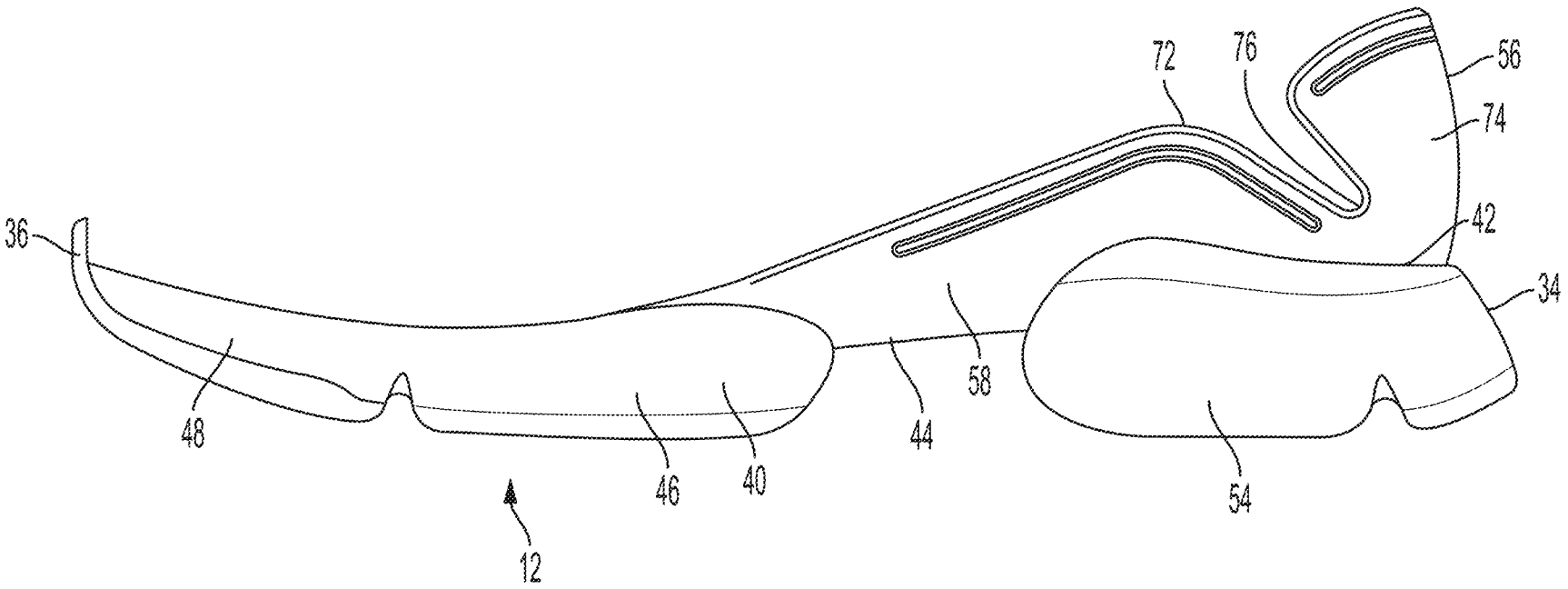
FIG. 6 is a medial side view of the sole of the shoe shown in FIG. 1.
Figure 7:
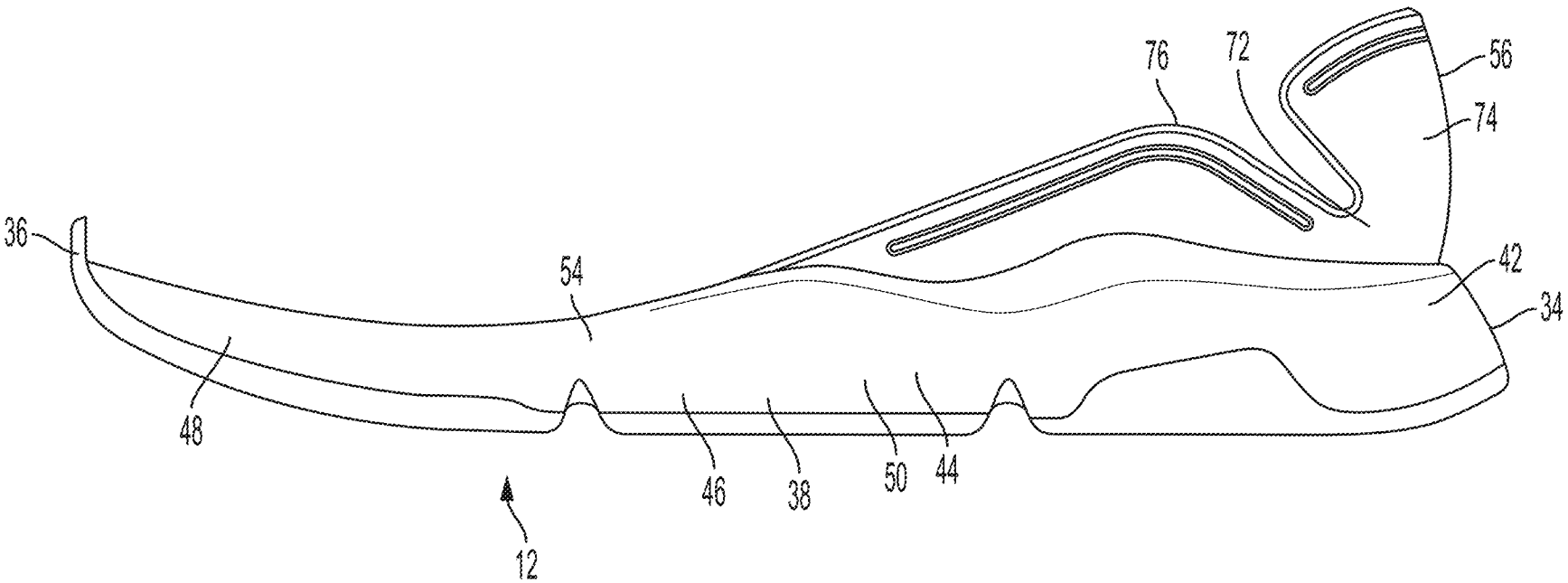
FIG. 7 is a lateral side view of the sole of the shoe shown in FIG. 1.
Figure 8:
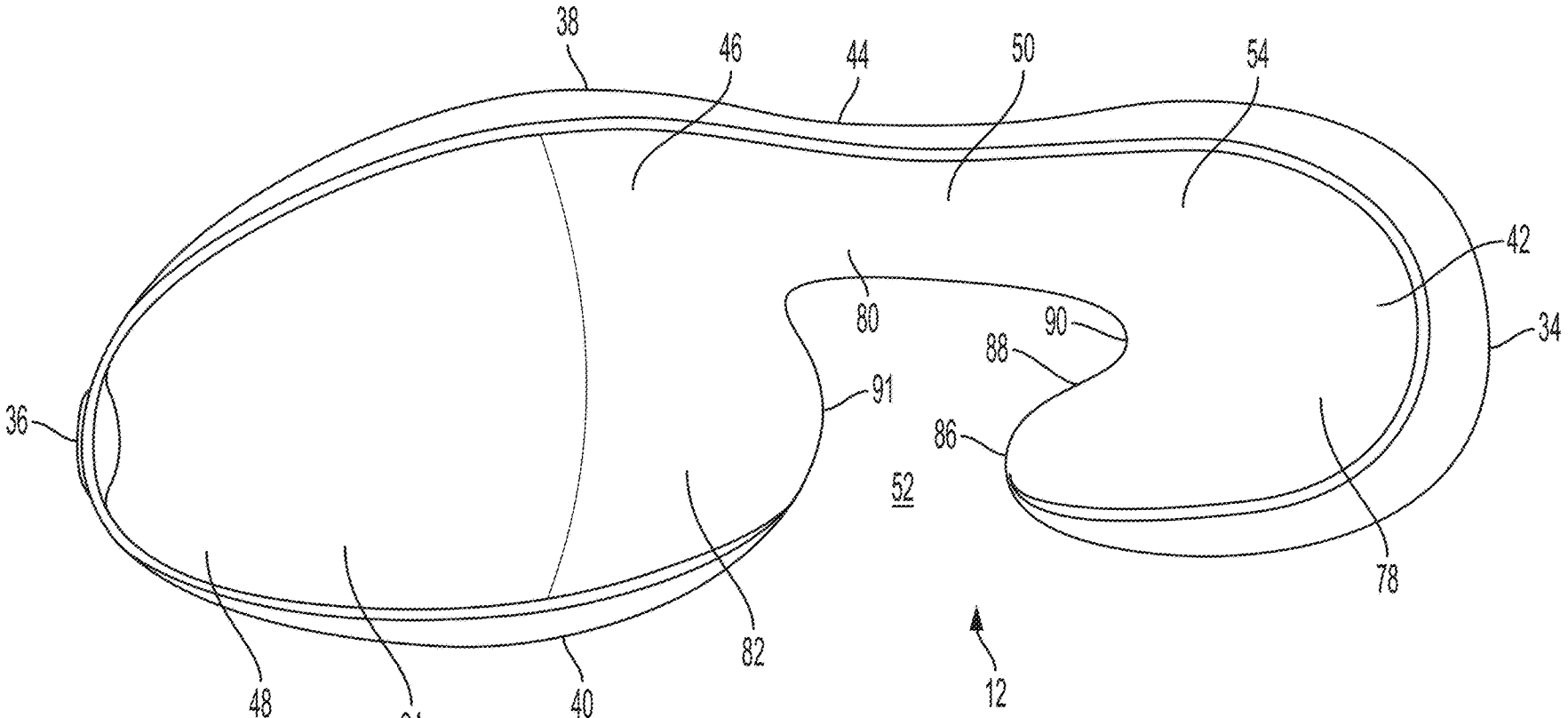
FIG. 8 is a top view of the midsole of the shoe shown in FIG. 1.
Figure 10:
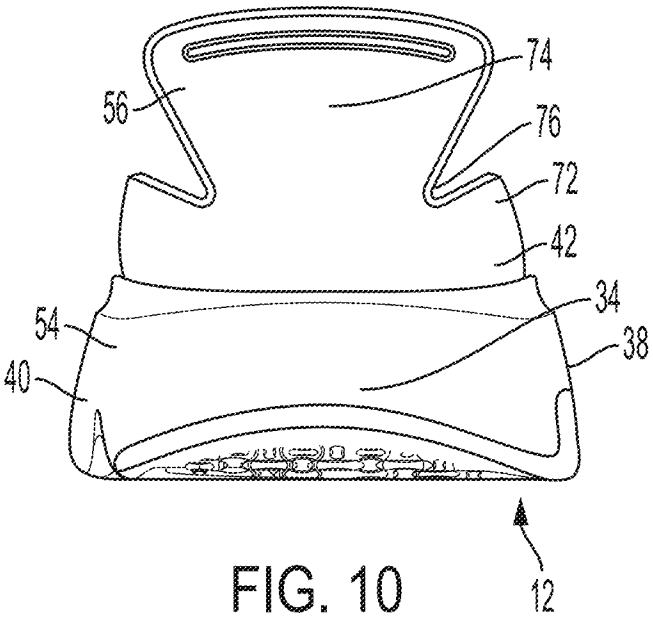
FIG. 10 is a rear view of the sole of the shoe shown in FIG. 1.
Figure 9:
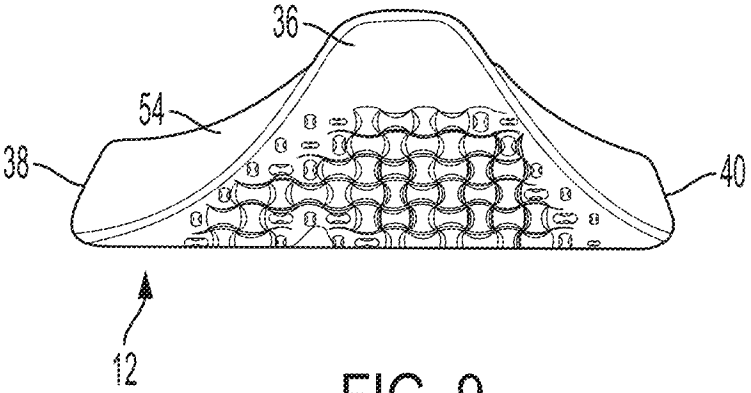
FIG. 9 is a front view of the midsole and the outsole of the shoe shown in FIG. 1.
Figure 11:
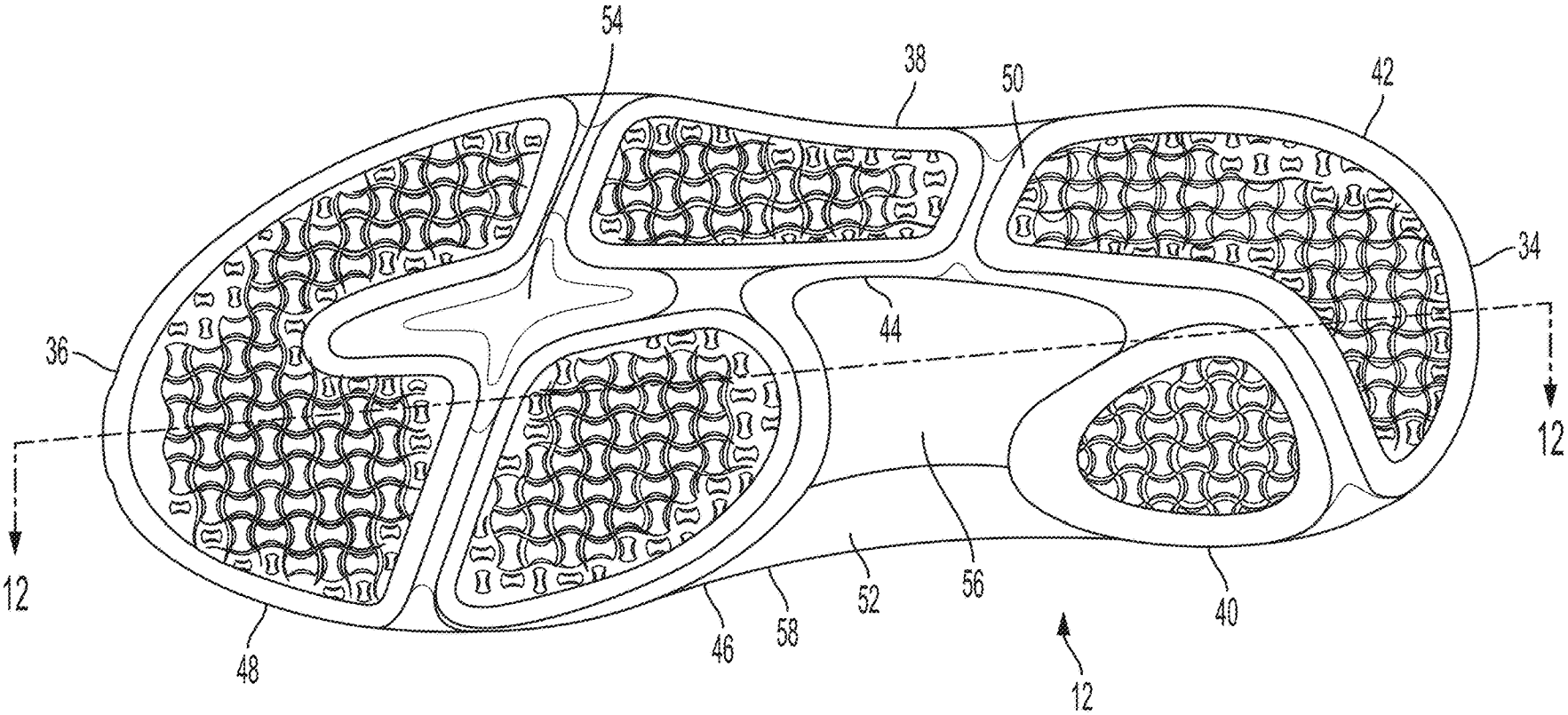
FIG. 11 is a bottom view of the midsole and outsole of the shoe shown in FIG. 1.
Figure 12:
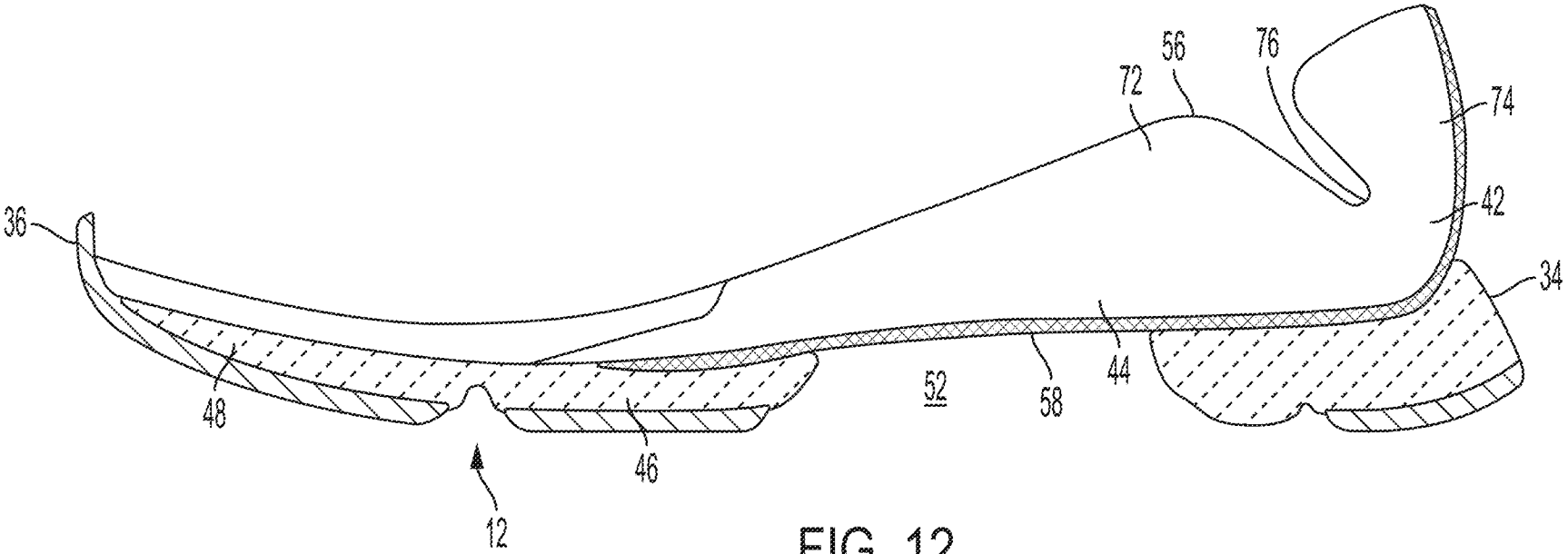
FIG. 12 is a cross-sectional view taken along the line 12-12.

Reference numerals in the written specification and in the drawing figures indicate corresponding items.

DETAILED DESCRIPTION

An embodiment of a shoe in accordance with the present disclosure is indicated by reference numeral 10. The shoe 10 includes a sole, generally indicated at 12, and a knit upper, generally indicated at 14. The sole 12 is secured to the upper 14. For example, and without limitation, the upper 14 is stitched, glued, or otherwise suitably secured to the sole 12. The shoe 10 extends forward from a heel end 18 to a toe end 19. The knit upper 14 has a knitted element 20.

The knitted element 20 is formed of a unitary one-piece construction during a knitting process on a knitting machine (not shown). The upper 14, including the knitted element 20, includes a toe region 22, a vamp region 24, a throat region 26, and a quarter region 28. The vamp region includes a lateral vamp region 30 and a medial vamp region 32. The toe region 22 extends longitudinally to the vamp region 24. The vamp region 24 extends longitudinally and laterally to the throat region 26. The lateral vamp region 30 extends laterally and in a lateral direction from the throat region 26. The medial vamp region 32 extends laterally and in a medial direction from the throat region 26. The vamp region extends longitudinally to the quarter region 28.

The knitted element 20 includes an integral tongue 27 within the throat region 26. The integral tongue 27 is seamlessly connected with adjacent regions of the knitted element 20. For example, the integral tongue 27 is seamlessly connected with the lateral vamp region 30 and the medial vamp region 32. The integrated tongue 27 makes the upper 14 a sock-like upper.

The sole 12 extends longitudinally from a sole heel end 34 to a sole toe end 36. The sole 12 further extends transversely from a sole lateral edge 38 to a sole medial edge 40. The sole includes a heel region 42, a midfoot region 44, a ball region 46 and a toe region 48. The heel region 42 extends longitudinally from the sole heel end 34 to the midfoot region 44. The midfoot region 44 extends longitudinally from the heel region 42 to the ball region 46. The midfoot region 44 has a lateral midfoot region 50 and a medial midfoot region 52. The lateral midfoot region 50 extends transversely from the lateral edge 38 to the medial midfoot region 52. The medial midfoot region 52 extends transversely from the medial edge 40 to the lateral midfoot region 50. The ball region 46 of the sole 12 extends longitudinally from the midfoot region 44 to the toe region 48. The toe region 48 extends longitudinally from the ball region 46 to the sole toe end 36.

The sole 12 includes a sole member 54 and a molded chassis 56. The sole member 54 extends from the sole heel end 34 to the sole toe end 36. The molded chassis 56 is coupled to the sole member 54. For example, and without limitation, the molded chassis 56 is coupled to the sole member 54 with one or more of adhesive, stitching, or other suitable material or technique. The molded chassis 56 has at least a midfoot region 58. The midfoot region 58 extends upwardly above a portion of the upper 14. The midfoot region 58 of the molded chassis member 56 is in the midfoot region of the sole 44.

The shoe 10 further includes a lateral stiffening member 60 and a medial stiffening member 62. Both the lateral stiffening member 60 and the medial stiffening member 62 are adapted and configured to stiffen the upper 14. For example, and without limitation, the stiffening members are coupled to the knitted element 20 (e.g., using stitching, adhesive, or the like) such that stretching between adjacent rows and/or columns of stitches is limited. Additionally or alternatively, the stiffening members are constructed of a material that has a higher resistance to stretching (e.g., a higher Young's Modulus) than that of the knitted element 20. Because the stiffening members are coupled to the upper 14, the overall stretchiness of the upper 14 is limited in one or more directions by the stiffening members. For example, and without limitation, the stiffening members are constructed of leather, imitation leather, plastic, or other suitable materials. As a result of the interlinking of rows and/or columns of stitches and/or the higher stretch resistance of the stiffening members, stretching of the upper 14 in one or more directions is limited by the stiffening members coupled to the upper 14.

The lateral stiffening member 60 is coupled to the upper 14 in the lateral vamp region 30. For example, the lower edge of the lateral stiffening member 60 is stitched to the knitted element 20 in the lateral vamp region 30. Alternatively, the lateral stiffening member 60 is adhered to the knitted element 20. The lateral stiffening member 60 is coupled to the knitted element 20 adjacent the throat region 26.

The medial stiffening member 62 is coupled to the upper 14 in the medial vamp region 32. For example, the lower edge of the medial stiffening member 62 is stitched to the knitted element 20 in the medial vamp region 32. Alternatively, the medial stiffening member 62 is adhered to the knitted element 20. The medial stiffening member 62 is coupled to the knitted element 20 adjacent the throat region 26.

Both the medial stiffening member 62 and the lateral stiffening member 60 are spaced from the molded chassis member 56. The lateral stiffening member 60 and the medial stiffening member 62 are also spaced from the sole member 54. The lateral stiffening member 60 is operatively connected to the molded chassis 56 in at least the lateral midfoot region 50. The lateral stiffening member 60 may also be operatively connected to the sole member 54 in the lateral midfoot region 50. The lateral stiffening member 60 is further operatively coupled to the sole member 54 in the ball region 46. For example, the lateral stiffening member 60 is operatively coupled to the molded chassis 56 and/or the sole member 54 by a plurality of lateral reinforcing threads 64. The lateral reinforcing threads 64 extend downwardly from the throat region 26 of the upper 14 and toward the sole member 54. The plurality of lateral reinforcing threads 64 are adapted and configured to limit stretching of the knit upper 14 in at least one direction by securing adjacent rows of knit stitches. For example, the plurality of lateral reinforcing threads 64 limits stretching of the knit upper 14 in a direction parallel with one or more of the plurality of lateral reinforcing threads 64. Each reinforcing thread interlinks adjacent rows of stitches by passing through the stitches. This ties the adjacent rows of stitches together to limit stretching. Similarly, the reinforcing threads may interlock adjacent columns. For example, some of the lateral reinforcing threads may extend diagonally from the lateral stiffening member 60 to the molded chassis 56 and/or the sole member 54. The lateral stiffening member 60 overlaps at least a portion of at least some of the plurality of lateral reinforcing threads 64 where the lateral stiffening member 60 is coupled to the upper 14. Using a combination of lateral reinforcing threads 64 at different angles, the plurality of lateral reinforcing threads 64 limits stretching of the knit upper 14 in one or more of an upward direction, a lateral direction, and a longitudinal direction.

The medial stiffening member 62 is operatively connected to the molded chassis 56 in at least the medial midfoot region 52. The medial stiffening member 62 may also be operatively connected to the sole member 54 in the medial midfoot region 20. The medial stiffening member 62 is further operatively coupled to the sole member 54 in the ball region 46. For example, the medial stiffening member 62 is operatively coupled to the molded chassis 56 and/or the sole member 54 by a plurality of medial reinforcing threads 66. The medial reinforcing threads 66 extend downwardly from the throat region 26 of the upper 14 and toward the sole member 54. The plurality of medial reinforcing threads 66 are adapted and configured to limit stretching of the knit upper 14 in at least one direction by securing adjacent rows of knit stitches. For example, the plurality of medial reinforcing threads 66 limits stretching of the knit upper 14 in a direction parallel with one or more of the plurality of medial reinforcing threads 66. Each reinforcing thread interlinks adjacent rows of stitches by passing through the stitches. This ties the adjacent rows of stitches together to limit stretching. Similarly, the reinforcing threads may interlock adjacent columns. For example, some of the medial reinforcing threads may extend diagonally from the medial stiffening member 62 to the molded chassis 56 and/or the sole member 54. The medial stiffening member 62 overlaps at least a portion of at least some of the plurality of medial reinforcing threads 66 where the medial stiffening member 62 is coupled to the upper 14. Using a combination of medial reinforcing threads 66 at different angles, the plurality of medial reinforcing threads 66 limits stretching of the knit upper 14 in one or more of an upward direction, a lateral direction, and a longitudinal direction.

The lateral stiffening member 60 and the medial stiffening member 62 each define at least one opening 68 adapted and configured to receive a shoe lace. With a lace passing through the openings 68 of the lateral and medial stiffening members 60, 62, the midfoot of the shoe 10 is able to be securely laced around a user's foot. By securing the two stiffening members together with the lacing, the overall stiffness of the shoe 10 is further increased. In this way, the looseness and high stretchiness of the knit construction of the upper 14 can be mitigated while retaining the benefits of a knit upper (e.g., breathability).

In some embodiments, the shoe 10 further includes a toe stiffening member 70. The toe stiffening member 70 is coupled to the knitted element 20 in the toe region 22. The toe stiffening member 70 is adhered to the knitted element 20 in the toe region 22 such that adjacent rows and/or columns of stitches are secured to one another thereby increasing the stiffness and limiting stretching of the knitted element 20 in the toe region 22. The toe stiffening member 70 may be any suitable material, such as leather, plastic, transparent or semi-transparent plastic or polymer, or the like. The toe stiffening member 70 may also be attached to the knitted upper using any suitable method such as stitching, adhesive, or the like.

The molded chassis 56 may also further stiffen the shoe 10 and/or otherwise provide support to a user's foot. In some embodiments, the molded chassis 56 includes, in addition to the midfoot region 58, a heel region 72 and a heel end region 74. The heel region 72 and the heel end region 74 extend upwardly above a portion of the upper 14. The heel end region 74 extends longitudinally from the sole heel end 34 to the heel region 72 of the molded chassis 56. The heel region 72 of the molded chassis 56 extends longitudinally from the heel end region 74 of the molded chassis 56 to the midfoot region of the molded chassis 58. The midfoot region 58 of the molded chassis 56 extends longitudinally from the heel region 72 of the molded chassis 56 toward the sole toe end 36.

The molded chassis member 56 generally decreases in height from the sole member 54 as the molded chassis member 56 extends from the heel end region 74. At least a portion of the heel end region 74 of the molded chassis 56 extends vertically from the sole member 54 a first length. At least a portion of the heel region 72 of the molded chassis 56 extends vertically from the sole member 54 a second length, the second length being lesser than the first length. At least a portion of the midfoot region 58 of the molded chassis 56 extends vertically from the sole member 54 a third length, the third length being lesser than the second length.

In some embodiments, the molded chassis 56 includes a notched portion 76 in the heel region 72. The notched portion 76 is concave and extends downwardly toward the sole member 54. The notched portion 76 may increase flexibility of the molded chassis 56 in the heel region 72, while the molded chassis 56 increases rigidity in other areas of the shoe 10 (e.g., to support the Achilles tendon, midfoot, etc.).

In some embodiments, the sole member 54 has a heel portion 78, a midfoot portion 80, a ball portion 82, and a toe portion 84. The heel portion 78 extends from the sole heel end 34 toward the midfoot region 44 and from the sole medial edge 40 to the sole lateral edge 38. The midfoot portion 80 extends from the heel portion 78 to the ball portion 82 and being only in the lateral midfoot region 50. The medial midfoot region 52 of the sole 12 is devoid of the midfoot portion 80 of the sole member 54 such that the chassis member 56 is visible as viewed in a bottom plan view. The ball portion 82 of the sole member 54 extends from the midfoot portion 80 toward the sole toe end 36 and from the sole medial edge 40 to the sole lateral edge 38. The toe portion 84 of the sole member 54 extending from the ball portion 82 to the sole toe end 36 and from the sole medial edge 40 to the sole lateral edge 38.

The heel portion 78 of the sole member 54 curves inward and convexly from the sole medial edge 40 toward the sole toe end 36 and to a first apex 86. The first apex 86 faces toward the sole toe end 36. The heel portion 78 of the sole member 54 curves inward and convexly from the first apex 86 toward an inflection point 88 and a second apex 90. The inflection point is positioned longitudinally between the first apex 86 and the second apex 90. The heel portion 78 of the sole member 54 curves inward and concavely from the inflection point 88 to the second apex 90. The second apex faces toward the sole heel end 34. The heel portion 78 of the sole member 54 curves inward and concavely away from the second apex 90 toward the sole lateral edge 38 and tapers toward the sole lateral edge 38 as the heel portion 78 extends toward the sole toe 36. The ball portion 82 of the sole member 54 curves inward and convexly from the sole medial edge 40 toward the sole heel end 34 and to a third apex 91. The third apex faces toward the sole heel end 34. The ball portion 82 curves inward and convexly from the third apex 91 toward the sole lateral edge 38.

In some embodiments, the heel portion 78 of the sole member 54 is thicker than the ball portion 82 of the sole member 54 and thicker than the toe portion 84 of the sole member 54. The sole member 54 is generally cup shaped defining a cavity 92. The molded chassis 56 is positioned within the cavity 92 such that the sole member 54 extends upwardly above a portion of the molded chassis 56.

In some embodiments, the shoe 10 further includes an outsole 93. The outsole 93 is adapted and configured to engage with the ground. The outsole 93 extends from the sole heel end 34 to the sole toe end 36 and is coupled to the sole member 54. The outsole includes a first outsole member 94 and a second outsole member 95. The first outsole member 94 extends longitudinally from the sole heel end 34 to the midfoot region 44. The second outsole member 95 extends longitudinally from the sole toe end 36 to the midfoot region 44. The first outsole member 94 is separated from the second outsole member 95. This increases flexibility of the sole 12 in the midfoot region 44.

In some embodiments, the shoe 10 further includes an insole 96 and a shank 97. The insole 96 is positioned within the upper 14 and extends from the toe end 19 to the heel end 18. The insole further extends laterally between the lateral edge and medial edge of the shoe 10. The insole includes a cutout 98 in the ball region, the midfoot region, and the heel region. The cutout is adapted and configured to receive the shank 97 such that the shank 97 is flush with the toe region of the insole 96 when positioned within the cutout 98. The shank is coupled to the insole 96 and extends longitudinally and continuously from the heel end 78 to within the ball region of the shoe 10. The shank 97 has a medial portion 99 and a lateral portion 100. The medial portion of the shank 99 extends closer to toe end 19 than the lateral portion 100 of the shank 97. Advantageously, this non-symmetrical configuration compensates for the shape of the sole member 54 which is not present in the medial midfoot region 52 of the sole 12. The shank 97 stiffens the sole 12 and supports a user's foot within the shoe 10.

Figure 13:
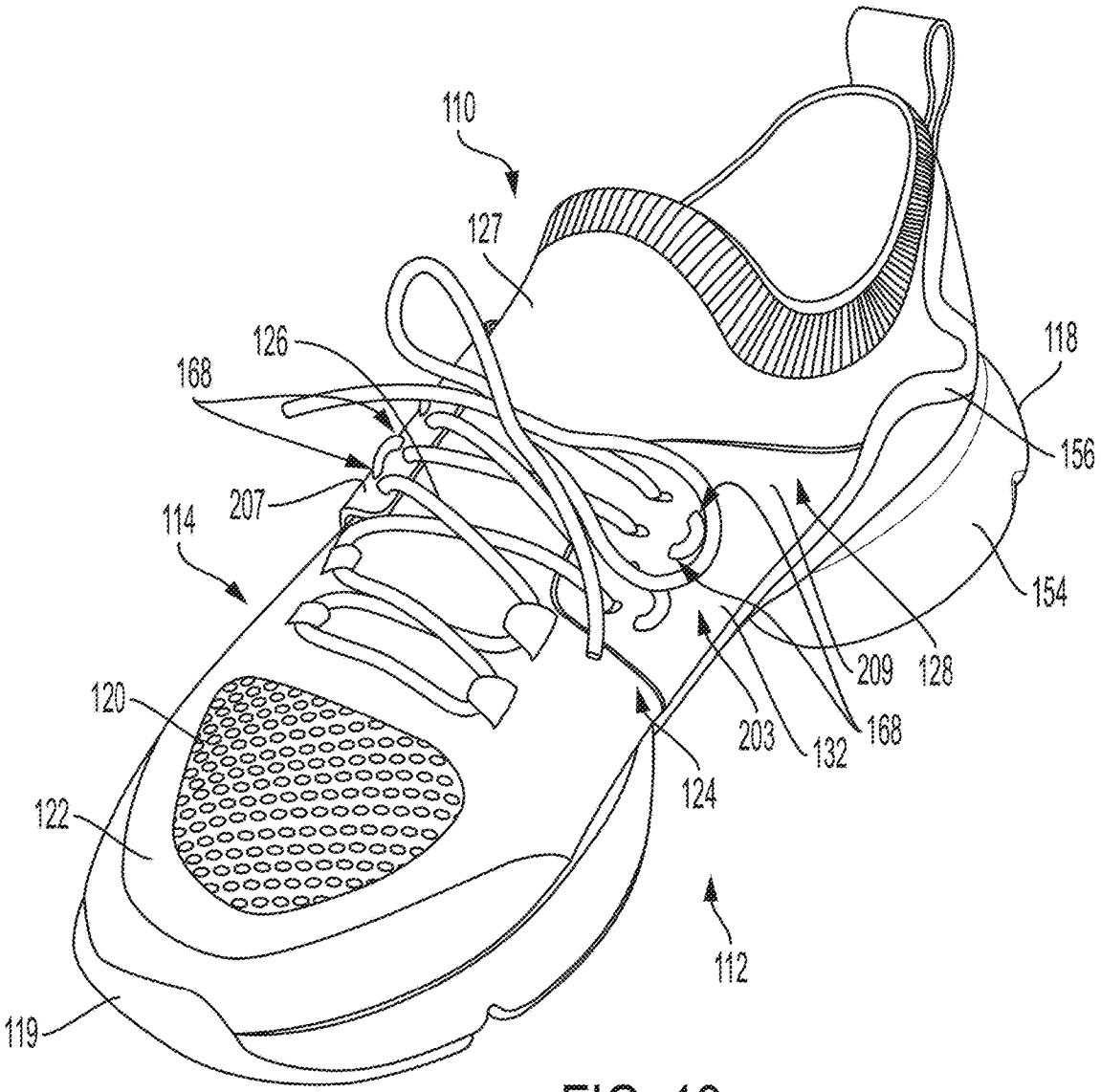
FIG. 13 is a perspective view of an embodiment of a shoe, the shoe including a stiffening member.
Figure 14:
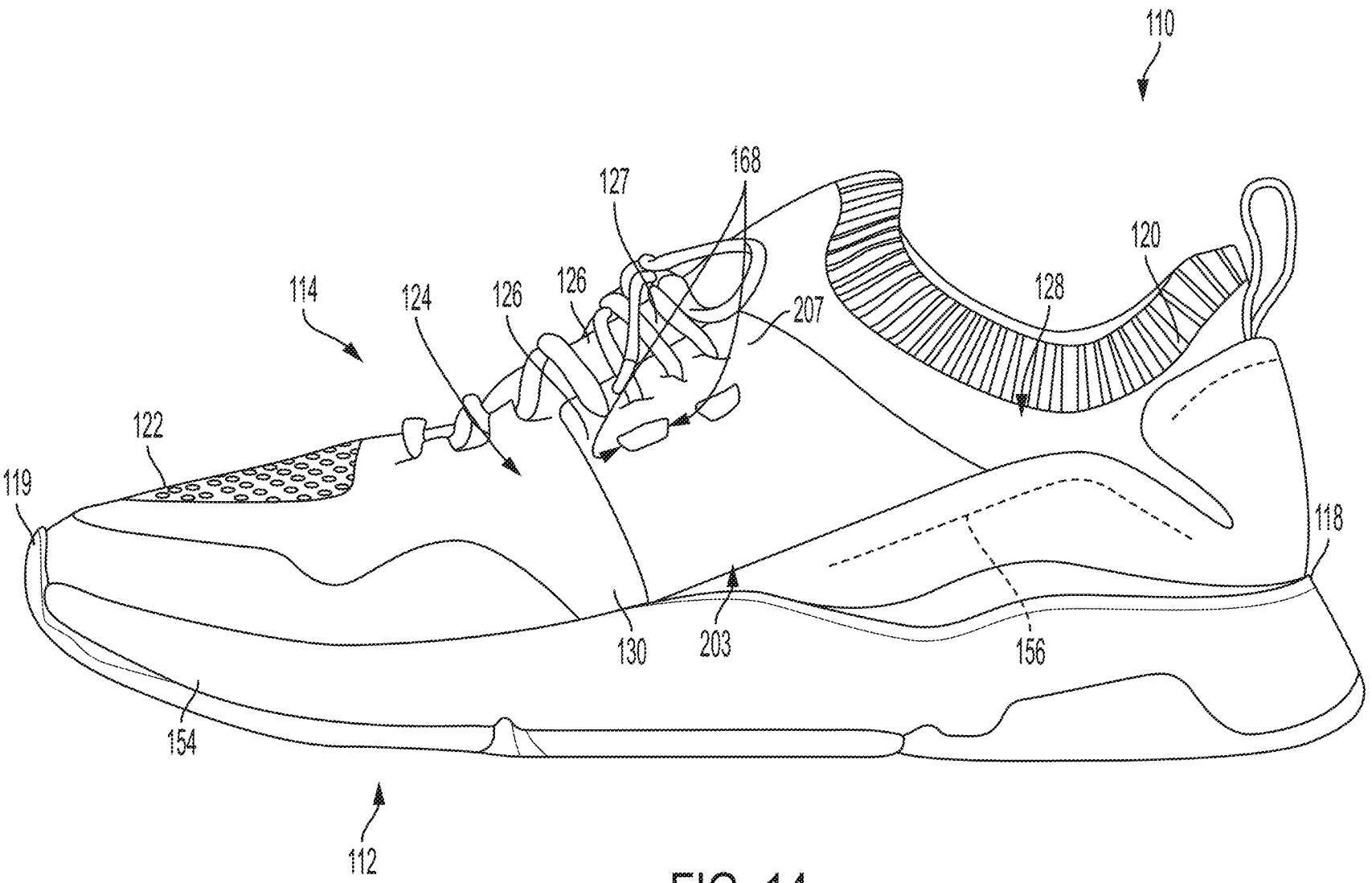
FIG. 14 is a lateral view of the shoe shown in FIG. 13.
Figure 15:
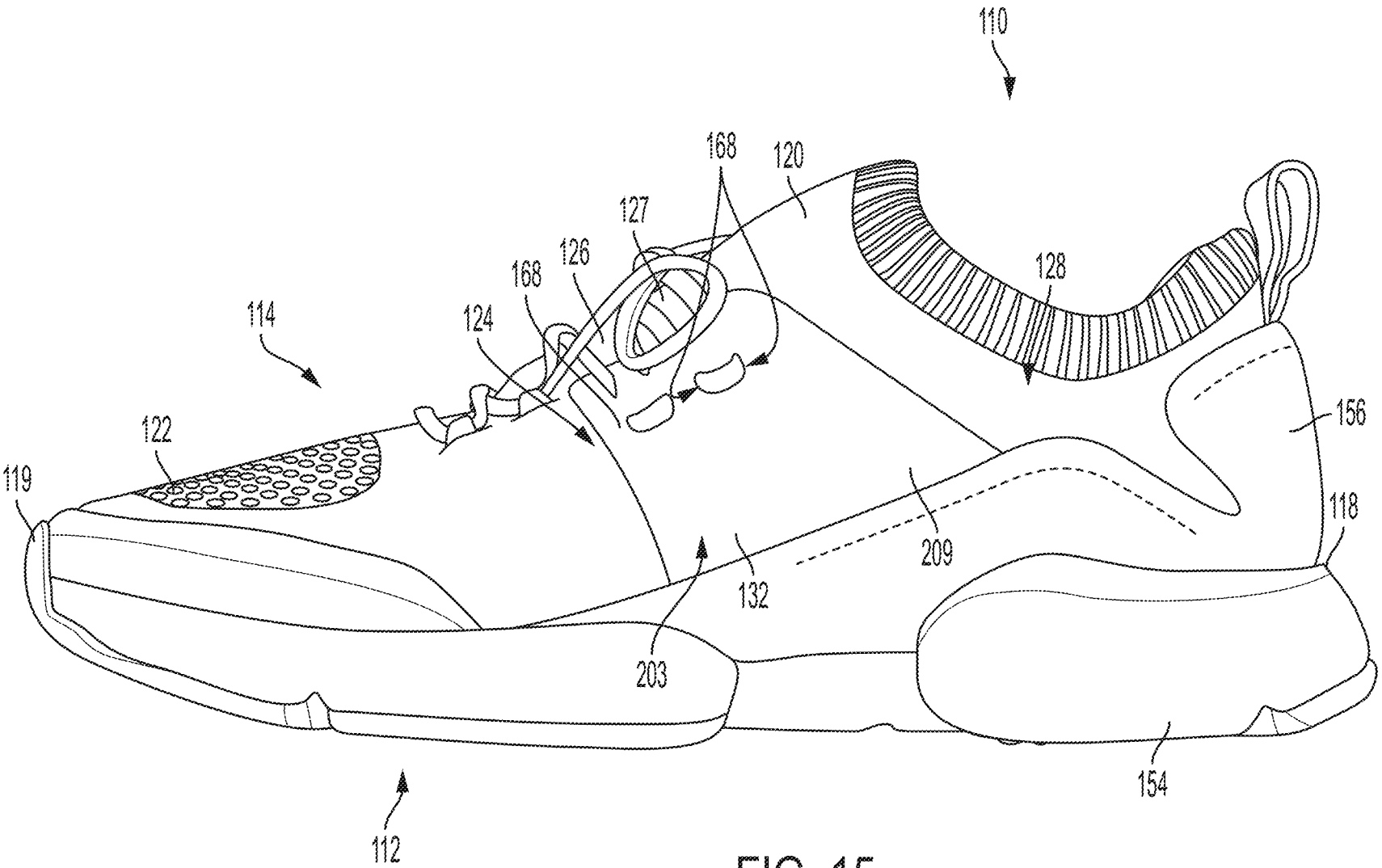
FIG. 15 is a medial view of the shoe shown in FIG. 13.
Figure 16:
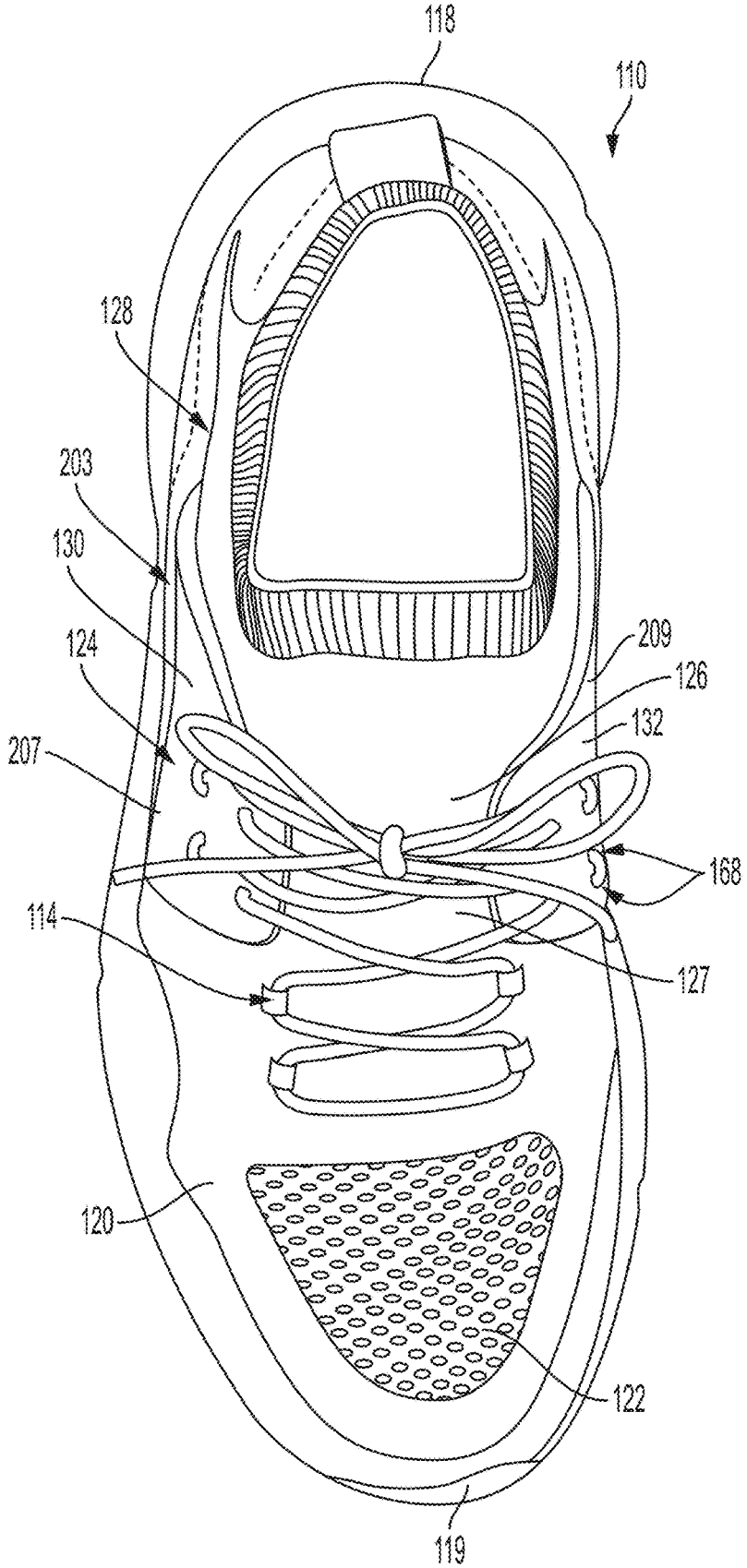
FIG. 16 is a top view of the shoe shown in FIG. 13.
Figure 17:
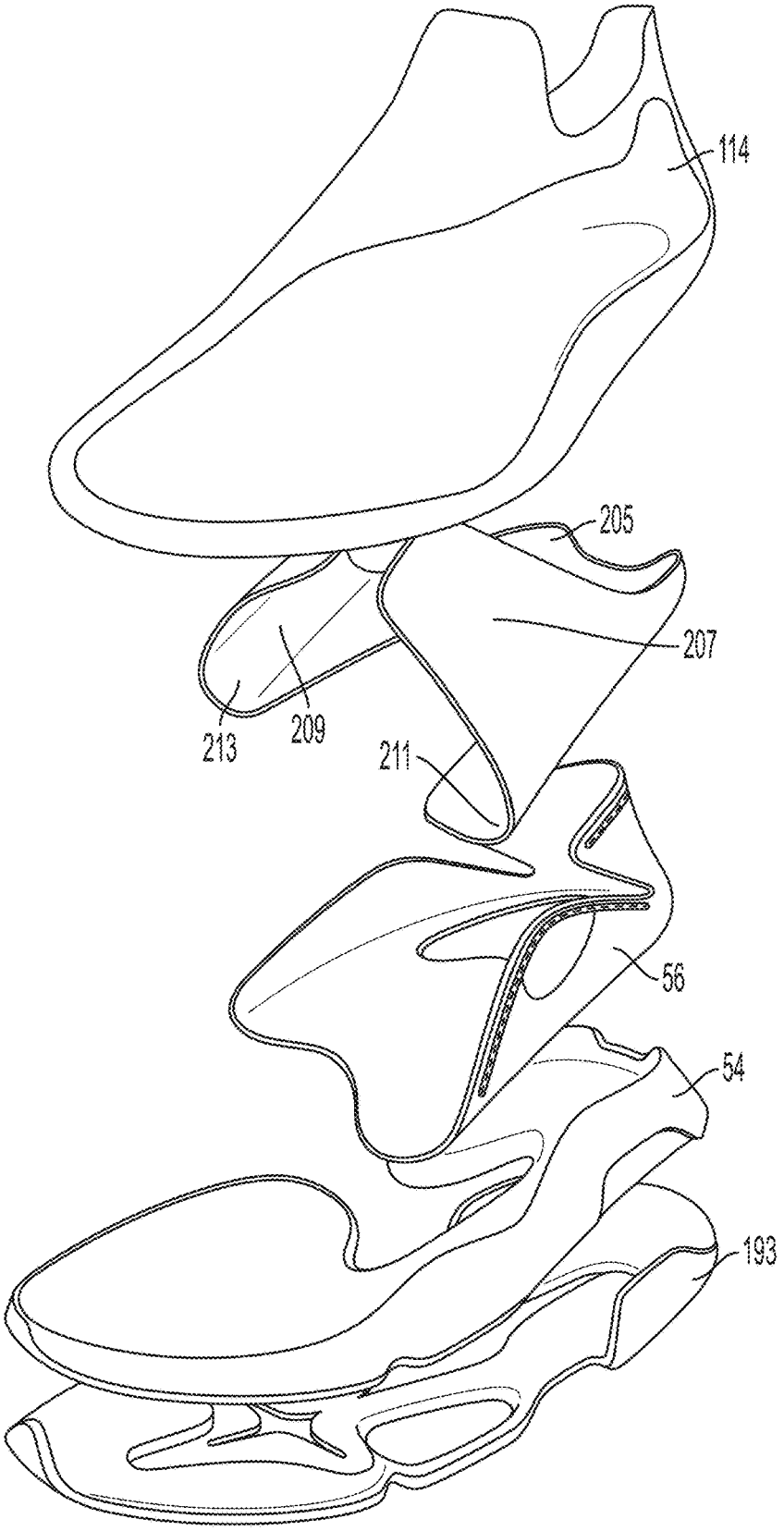
FIG. 17 is an exploded view of the shoe shown in FIG. 13.

Referring now to FIGS. 13-17 another embodiment of the shoe 10 is shown and is generally indicated with reference numeral 110. It should be understood that parts referred to with similar reference numerals in each embodiment share substantially the same or the same function and/or characteristics. For example, and without limitation, the shoe 10 includes a molded chassis 56 and the shoe 110 includes a molded chassis 156. Where substantially different, the components of the shoe 110 are further described below.

The shoe 110 does not include lateral or medial reinforcing threads. The shoe 110 has a single piece outsole 193 that may include several through openings. The molded chassis member 156 includes a through opening 201 in the heel region 172.

The shoe 110 includes a unitary one-piece stiffening member 203. This is in contrast to the two separate stiffening members of the shoe 10. The one-piece stiffening member 203 has a bottom portion 205, a lateral side portion 207, and a medial side portion 209. The bottom portion 205 extending laterally between a first end 211 and a second end 213, the second opposite the first end. The lateral side portion 207 extends upwardly from the first end 211 of the bottom portion 205. The medial side portion 209 extends upwardly from the second end 213 of the bottom portion 205. The stiffening member 203 is positioned between the molded chassis 156 and the upper 114. More specifically, the bottom portion 205 is in contact with the midfoot region 158 of the molded chassis member 156 (e.g., the bottom portio 205 is stitched, glued or otherwise attached to the molded chassis member 156 in the midfoot region 158). The upper 114 is positioned over the bottom portion 205 and between the lateral side portion 207 and the medial side portion 209. The upper 114 may be secured to the stiffening member 203. For example, and without limitation, the upper 114 may be stitched or glued to the bottom portion 205. The lateral side portion 207 and the medial side portion 209 are not coupled to the upper 114 but are capable of moving independently from the upper 114. The stiffening 203 stiffens the upper 114 when the shoe 110 is laced, as the laces pass through openings 168 in the stiffening member 203. Additionally, the stiffening member 203 is constructed of a stiffer material than the knit upper 114. For example, and without limitation, the stiffening member 203 is constructed of leather, imitation leather, rubber, plastic, or any other suitable material. In alternative embodiments, the lateral side portion 207 and/or medial side portion 209 are coupled to the upper (e.g., stitched or glued to the upper).

In view of the foregoing, it should be appreciated that the shoe of the disclosure has several advantages over the prior art.

As various modifications could be made in the constructions and methods herein described and illustrated without departing from the scope of the disclosure, it is intended that all matter contained in the foregoing description or shown in the accompanying drawings shall be interpreted as illustrative rather than limiting. For example, the wedge shoe may be any type of wedge shoe, such as a wedge sandal, a wedge pump, an open-toe wedge, a platform wedge, etc. Thus, the breadth and scope of the present disclosure should not be limited by any of the above-described exemplary embodiments, but should be defined only in accordance with the following claims appended hereto and their equivalents It should also be understood that when introducing elements in the present disclosure in the claims or in the above description of exemplary embodiments of the disclosure, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations.

What is claimed is:

1. A shoe comprising:

a sole;

an upper secured to the sole, the upper having a knitted element being formed of a unitary one-piece construction during a knitting process on a knitting machine, the upper having a toe region, a vamp region having a lateral vamp region and a medial vamp region, a throat region, and a quarter region, the toe region extending longitudinally to the vamp region, the vamp region extending longitudinally and laterally to the throat region, the lateral vamp region extending laterally and in a lateral direction from the throat region, the medial vamp region extending laterally and in a medial direction from the throat region, the vamp region extending to the quarter region;

a lateral stiffening member coupled to the upper in the lateral vamp region, the lateral stiffening member adapted and configured to stiffen the upper and having a higher resistance to stretching than the knitted element; and a medial stiffening member coupled to the upper in the medial vamp region, the medial stiffening member adapted and configured to stiffen the upper and having a higher resistance to stretching than the knitted element;

the sole extending longitudinally from a sole heel end to a sole toe end and extending transversely from a sole lateral edge to a sole medial edge, the sole including a heel region, a midfoot region, a ball region and a toe region, the heel region extending longitudinally from the sole heel end to the midfoot region, the midfoot region extending longitudinally from the heel region to the ball region and having a lateral midfoot region and a medial midfoot region, the lateral midfoot region extending transversely from the lateral edge to the medial midfoot region, the medial midfoot region extending transversely from the medial edge to the lateral midfoot region, the ball region of the sole extending longitudinally from the midfoot region to the toe region, and the toe region extending longitudinally from the ball region to the sole toe end, the sole having a sole member and a molded chassis, the sole member extending from the sole heel end to the sole toe end, the molded chassis coupled to the sole member, the molded chassis having at least a midfoot region, the midfoot region extending upwardly above a portion of the upper, the midfoot region of the molded chassis member being in the midfoot region of the sole, the lateral stiffening member being spaced from the molded chassis and being spaced from the sole member, the lateral stiffening member being operatively connected to the molded chassis in the midfoot region, the lateral stiffening member defining at least one opening adapted and configured to receive a shoe lace, the medial stiffening member being spaced from the molded chassis and being spaced from the sole member, the medial stiffening member being operatively connected to the molded chassis in the midfoot region, the medial stiffening member defining at least one opening adapted and configured to receive a shoe lace.

2. A shoe in accordance with claim 1, wherein the lateral stiffening member is further operatively connected to the sole member in the ball region, and wherein the medial stiffening member is further operatively connected to the sole member in the ball region.

3. A shoe in accordance with claim 1, wherein the lateral stiffening member is adjacent the throat region, and wherein the medial stiffening member is adjacent the throat region.

4. A shoe as set forth in claim 1, the upper including a plurality of lateral reinforcing threads extending downwardly from the throat region of the upper and toward the sole member, the plurality of lateral reinforcing threads being adapted and configured to limit stretching of the knit upper in at least one direction by securing adjacent rows of knit stitches, the lateral stiffening member overlapping at least a portion of at least some of the plurality of lateral reinforcing threads where the lateral stiffening member is coupled to the upper.

5. A shoe in accordance with claim 4, wherein the lateral stiffening member is operatively connected to the molded chassis by the plurality of lateral reinforcing threads.

6. A shoe as set forth in claim 4, wherein the plurality of lateral reinforcing threads limit stretching of the knit upper in a direction parallel with one or more of the plurality of lateral reinforcing threads.

7. A shoe as set forth in claim 4, wherein the plurality of lateral reinforcing threads limit stretching of the knit upper in one or more of an upward direction, a lateral direction, and a longitudinal direction.

8. A shoe as set forth in claim 1, the upper including a plurality of lateral reinforcing threads extending downwardly from the lateral reinforcing member and toward the sole member, the plurality of lateral reinforcing threads being adapted and configured to limit stretching of the knit upper in at least one direction by securing adjacent rows of knit stitches.

9. A shoe as set forth in claim 1, the upper including a plurality of medial reinforcing threads extending downwardly from the throat region of the upper and toward the sole member, the plurality of medial reinforcing threads being adapted and configured to limit stretching of the knit upper in at least one direction by securing adjacent rows of knit stitches, the medial stiffening member overlapping at least a portion of at least some of the plurality of medial reinforcing threads where the medial stiffening member is coupled to the upper.

10. A shoe in accordance with claim 9, wherein the medial stiffening member is operatively connected to the molded chassis by the plurality of medial reinforcing threads.

11. A shoe in accordance with claim 9, wherein the plurality of medial reinforcing threads limit stretching of the knit upper in a direction parallel with one or more of the plurality of medial reinforcing threads.

12. A shoe in accordance with claim 9, wherein the plurality of medial reinforcing threads limit stretching of the knit upper in one or more of an upward direction, a lateral direction, and a longitudinal direction.

13. A shoe as set forth in claim 1, the upper including a plurality of medial reinforcing threads extending downwardly from the medial reinforcing member and toward the sole member, the plurality of medial reinforcing threads being adapted and configured to limit stretching of the knit upper in at least one direction by securing adjacent rows of knit stitches.

14. A shoe in accordance with claim 1, the knitted element including an integral tongue within the throat region, the integral tongue seamlessly connected with adjacent regions of the knitted element.

15. A shoe in accordance with claim 1, the molded chassis further having a heel region and a heel end region, the heel region and the heel end region extending upwardly above a portion of the upper, the heel end region extending longitudinally from the sole heel end to the heel region of the molded chassis, the heel region of the molded chassis extending longitudinally from the heel end region of the molded chassis to the midfoot region of the molded chassis, the midfoot region of the molded chassis extending longitudinally from the heel region of the molded chassis toward the sole toe end.

16. A shoe in accordance with claim 15, at least a portion of the heel end region of the molded chassis extending vertically from the sole member a first length, at least a portion of the heel region of the molded chassis extending vertically from the sole member a second length, the second length being lesser than the first length, at least a portion of the midfoot region of the molded chassis extending vertically from the sole member a third length, the third length being lesser than the second length.

17. A shoe in accordance with claim 15 wherein the molded chassis includes a notched portion in the heel region, the notch being concave and extending downwardly toward the sole member.

18. A shoe as set forth in claim 1, the sole further having an outsole, the outsole extending from the sole heel end to the sole toe end, the sole member coupled to the outsole, the outsole comprising a first outsole member and a second outsole member, the first outsole member extending longitudinally from the sole heel end to the midfoot region, the second outsole member extending longitudinally from the sole toe end to the midfoot region, the first outsole member being separated from the second outsole member.

* * * * *